United States Patent [19]

Shikatani

[11] Patent Number: 4,574,960

[45] Date of Patent: Mar. 11, 1986

[54] DISPLAY STAND

[75] Inventor: Edward R. Shikatani, Toronto, Canada

[73] Assignee: Don Watt + Associates Communications, Inc., Toronto, Canada

[21] Appl. No.: 650,129

[22] Filed: Sep. 13, 1984

[30] Foreign Application Priority Data

Mar. 16, 1984 [CA] Canada ..... 449755

[51] Int. Cl.[4] ..... A47F 7/00

[52] U.S. Cl. ..... 211/60.1; 211/189; 211/194; 312/107; 312/198; 446/117; 446/124; D6/449; D6/474; D6/473

[58] Field of Search ..... 211/60.1, 189, 194, 211/133; 312/107, 117, 198, 254; D6/449, 474, 473, 329; 446/85, 117, 124

[56] References Cited

U.S. PATENT DOCUMENTS

| | | | |
|---|---|---|---|
| 208,921 | 10/1967 | Tapert | D33/3 |
| 229,263 | 11/1973 | Neglia | D6/188 |
| 232,994 | 11/1974 | Puente | D6/186 |
| 235,595 | 7/1975 | Dogliotti | D6/24 |
| 237,669 | 11/1975 | Neglia | D6/24 |
| 239,806 | 5/1976 | Bressickello | D6/188 |
| 240,098 | 6/1976 | Juhlin | D6/24 |
| 240,104 | 6/1976 | Juhlin | D6/189 |
| 242,011 | 10/1976 | Robertson, Jr. | D6/189 |
| 242,677 | 12/1976 | Milligan | D6/130 |
| 242,682 | 12/1976 | Cain | D6/189 |
| 245,047 | 7/1977 | Dogliotti | D6/25 |
| 246,408 | 11/1977 | Snediker et al. | D6/130 |
| 247,530 | 3/1978 | Edwards, Jr. | D6/24 |
| 248,267 | 6/1978 | Mitchell | D6/188 |
| 251,049 | 2/1979 | Gardner | D6/189 |
| 254,821 | 4/1980 | Rabas | D6/23 |
| 255,739 | 7/1980 | Winter et al. | D6/189 |
| 258,334 | 2/1981 | Fontiladosa | D6/157 |
| 265,702 | 8/1982 | Savas | D6/189 |
| 268,464 | 4/1983 | Sandy | D6/189 |
| 269,312 | 6/1983 | Marks, Jr. | D6/175 |
| 1,130,497 | 3/1915 | Dunham | 211/133 X |
| 1,822,571 | 9/1931 | Einson . | |
| 1,915,496 | 6/1933 | Johnson . | |
| 2,313,141 | 3/1943 | Garratt | 211/133 |
| 2,549,189 | 4/1951 | Gabo | 446/124 X |
| 3,051,319 | 8/1962 | Glaser | 211/133 |
| 3,203,124 | 8/1965 | Stoessel | 40/124.1 |
| 3,299,555 | 1/1967 | Scherotto | 40/124.1 |
| 3,771,795 | 11/1973 | Flanigen | 273/157 R |
| 4,095,858 | 6/1978 | Hopf | 312/198 |
| 4,179,033 | 12/1979 | Mitchell | 211/60 R |
| 4,187,948 | 2/1980 | Perrella | 211/71 |
| 4,253,561 | 3/1981 | Fontiladosa | 206/44 R |
| 4,289,245 | 9/1981 | Hasulak | 211/133 |
| 4,403,702 | 9/1983 | Belokin, Jr. | 211/189 |
| 4,423,913 | 1/1984 | Lee | 312/107 |

*Primary Examiner*—Robert W. Gibson, Jr.
*Assistant Examiner*—Blair M. Johnson
*Attorney, Agent, or Firm*—Bernard, Rothwell & Brown

[57] ABSTRACT

The present invention relates to a display stand and in particular relates to a maximum accessible density three-sided display stand. The stand comprises a base having a pyramid shape to which a first group of cubic cells are interconnected. The first group of three cubic cells are connected in such a fashion that their inside surfaces are adapted to receive a three-sided pyramid structure of the base. The cubic cells are each provided with an inclined open face for receiving the articles. The three faces open in directions generally 90° angles apart from each other. The display stand further includes a plurality of spacers which are cubes providing pyramid and inverted pyramid structures. Additional cubic cells of the same configuration as the first group of cubic cells are interspaced by the cube spacers.

17 Claims, 5 Drawing Figures

DISPLAY STAND

The present invention relates to display stands for articles and in particular relates to a display stand that maximizes the accessible density of articles on display.

While several display stands have been specifically developed for specialized products, particularly in the cosmetic industry, there is need for a display stand which will display and hold elongate articles such as, for example, cylinders containing mouth spray or the like. Presently, cylindrical articles are contained in large jars in which the articles become randomly oriented as each succeeding customer attempts to remove one or more of the articles from the jar. As a result, the display stand must constantly be tidied or is left with an untidy appearance thereby defeating the purpose of a display stand which is to promote the sale of a product. Alternatively, the cylindrical articles are arranged adjacent each other on a slanted shelf such that as one article is removed, the other articles roll down the shelf. One problem with this type of display stand is that it consumes a large amount of counter space. In certain environments, such as a convenience store or a drug store, counter space is in great demand and often the shelves in which the product is held must be stacked one above another consuming considerable space above and along the counter top. Furthermore, these stands tend to hide the product or article from view defeating the purpose of the display.

It is therefore an object of the present invention to provide a display stand which more efficiently uses counter space.

It is another object of the present invention to provide a display which maximizes the accessible density of product or articles within the space occupied by the display stand.

It is yet another object of the present invention to provide a display stand which displays a product in an orderly format and, as the product is emptied from the display stand by the consumer, the product orients itself in the stand.

In accordance with one aspect of the present invention there is provided a display stand for articles comprising a base having three converging sides defining a pyramid converging at a first apex. The stand includes a first group of cells which are interconnected to provide respective inside surface portions that at least partially conform to the shape of the converging sides and are each adapted to lie over at least a portion of a corresponding one of the converging sides. Each of the cells has an inclined opening for receiving one or more of the articles.

Additionally, the display stand may include one or more additional cell groups constructed in the same manner as the first group and one or more spacers interspacing the first and additional groups.

It is also envisaged that each of the spacers of the display stand may include upper and lower opposing sets of converging sides. The second upper set of converging sides are received by the inside surface portions of the groups of cells positioned above each spacer. The lower set of converging sides have edges between adjacent converging sides which rest on surfaces of the cell group below each spacer. Thus, it is not necessary that the entire inside surfaces of each group overlie the entire surface area of the converging sides.

The converging sides of both the base member and the spacers orientate the cells in an inclined position such that the articles contained in the cells tend to reposition themselves in an orderly fashion as articles are removed. By having the cells stacked above the base in the manner described, the cells face around the verticle axis extending up through the centre of the display stand thereby maximizing the accessible density of the articles in the stand and making more efficiently use of counter space. Most important, however, is that the display stand of the present invention maximizes the accessible space available for displaying and storing articles.

For a better understanding of the nature and objects of the present invention, reference may be had by way of example to the accompanying diagrammatic drawings which illustrate the preferred embodiment of the present invention and in which.

Figure 1:
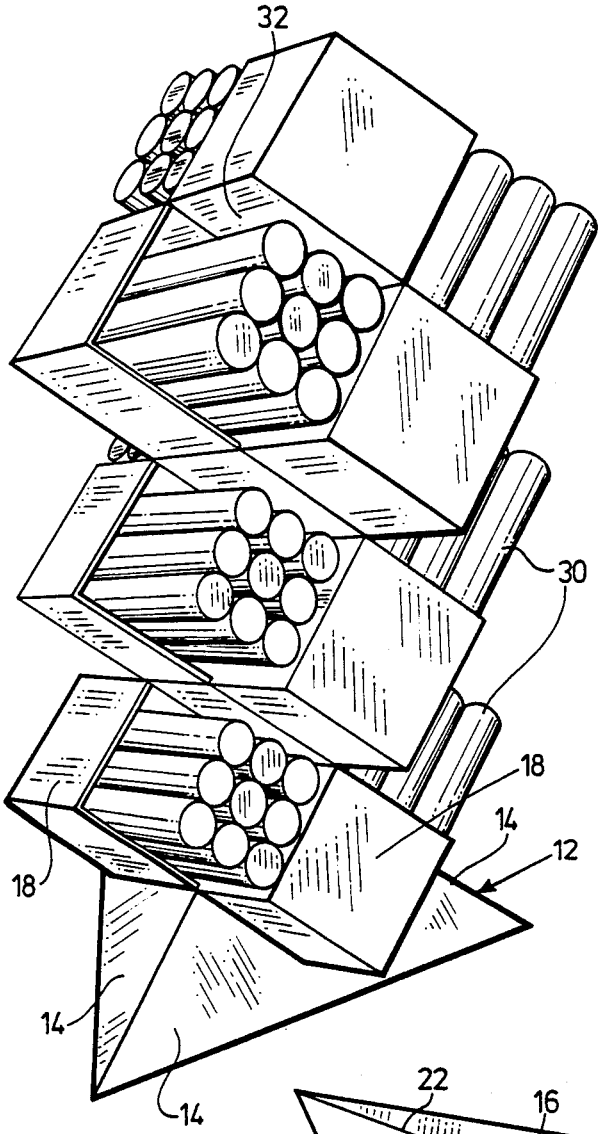
FIG. 1 is a perspective view of the display stand.
Figure 2:
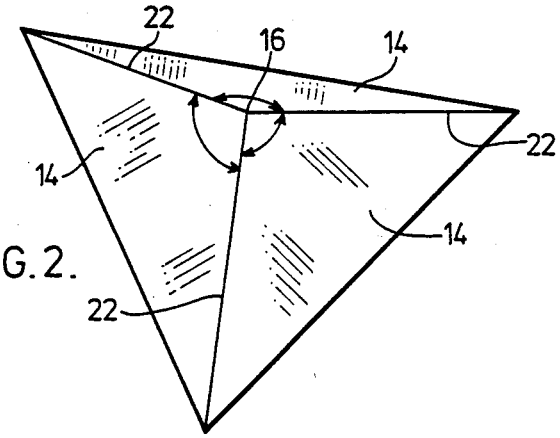
FIG. 2 is a perspective view of the base of the display stand.

Referring now to FIGS. 1 through 5, the display stand of the present invention is shown. The display stand 10 comprises a base 12 having three converging sides 14 which are planar sides and meet at an apex 16 such that the base 12 forms the shape of a three-sided pyramid. Secured and stacked immediately above the base 12 is a first group of cubic cells 18. The cells 18 are interconnected such that their inside surfaces 20 lie over side walls 14 of the pyramid. The angle at the apex between the adjacent edges 22 of the pyramid are each 90 degrees (FIG. 2).

Figure 3:
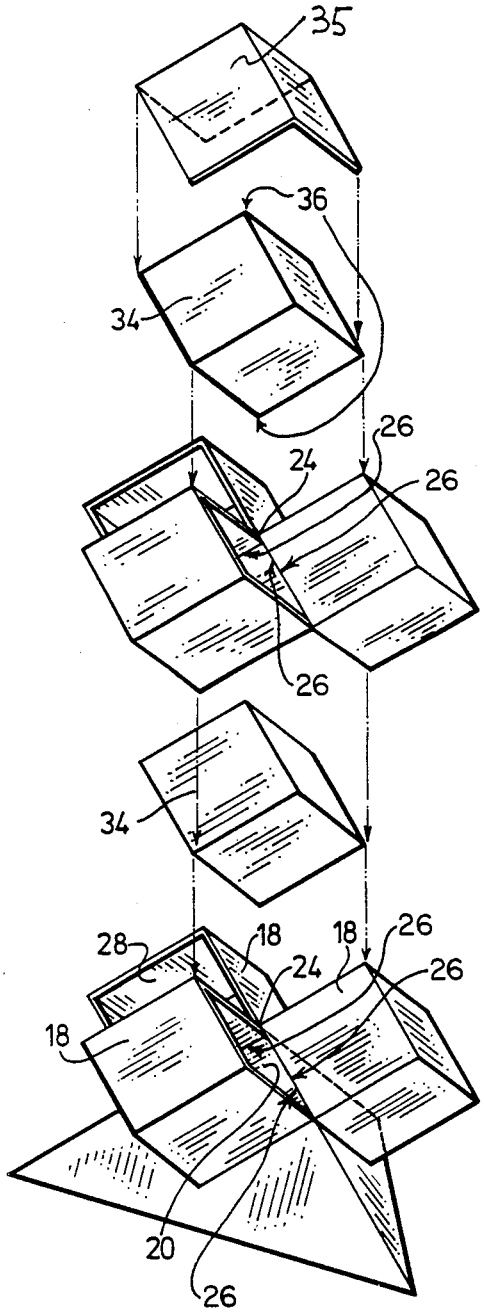
FIG. 3 is a partially exploded view of the display stand.
Figure 4:
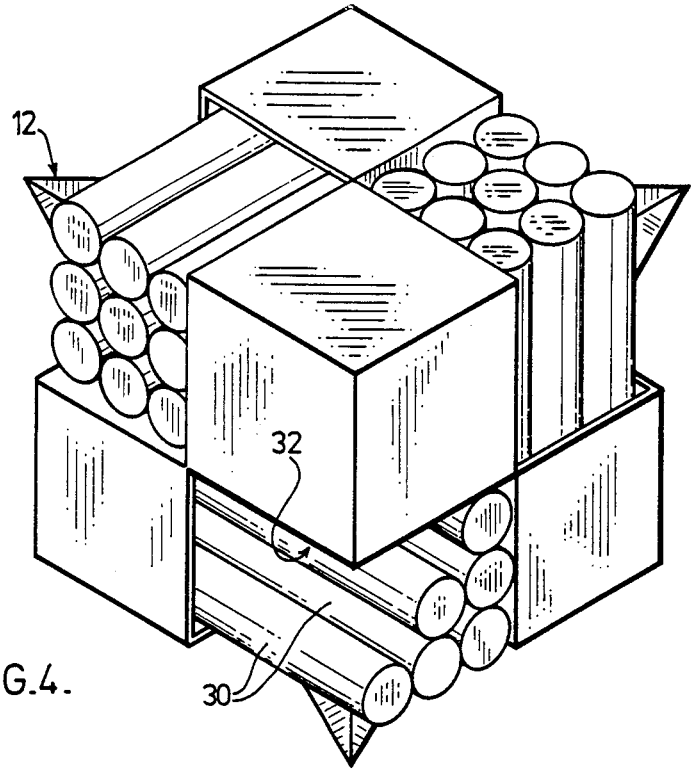
FIG. 4 is a plan view.
Figure 5:
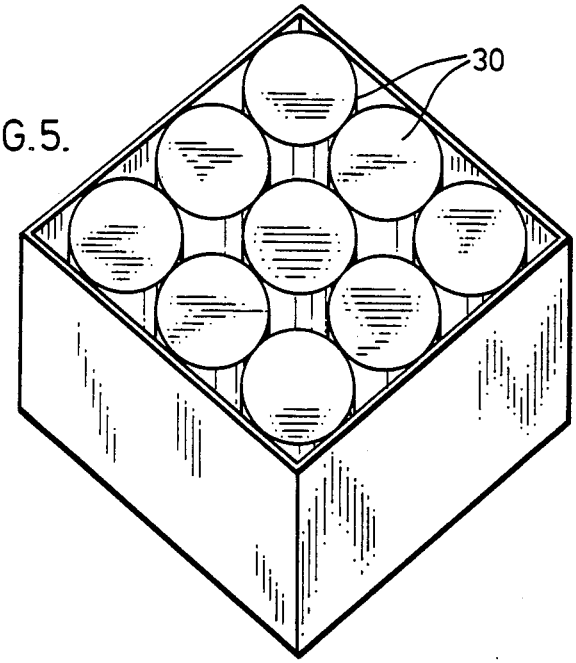
FIG. 5 is a front view of one cell of the present invention.

The cells 18 are joined at one corner or joint 24 such that the inside surfaces 20 receive the pyramid base 12 and extend outwardly of the stand in directions that are at right angles to each other. As shown in FIG. 3, edges 26 of adjacent right angled faces of cells 18 are attached to one another. Each of the cells 18 includes an inclined opened face 28 into which articles 30 may be inserted. The inclination of cell 18 is best shown in the front view of FIG. 5 and is 45° up from the horizontal plane. Open spaces 32 are provided between adjacent right angled faces of the cells 18. Access to the open face 28 of the cells 18 is permitted through the open spaces 32.

Positioned immediately above each group of cells 18 is a cubic spacer 34. Spacer 34 is oriented such that two of its opposing corners 36 are aligned vertically to define a pyramid having an upper apex and an inverted pyramid having a lower inverted apex. The lower corner 36 abuts the joint 24 and the upper corner 36 of the spacer 34 is received by the inside surfaces 20 of the cell group located above the spacer 34. As can be appreciated from FIG. 4, edge surfaces between adjacent faces of the spacer 34 rest upon edges of the cube cell 18 positioned below the spacer 34.

Each of the cells 18 is of the same size and is sized such that it is one-half the depth of the article 30 inserted into the cubes. By inclining the cells and subsequent spacers, the cells open front or face 28 faces in an upwardly and outwardly direction towards an adjacent or corresponding open space 32. Access to the cube is provided through open space 32. The spacers 34 space each group of cells 18 one cell distance above each other so that the cells do not overlap each other. It should be understood that the joints 24 of each cell group are in vertical alignment with the apex 16 of the base 12. This maintains the cells 18 of each group as close as possible to the centre of the vertical axis of the stand or the centre of gravity for the stand. It should be understood that three, four, or more cell groups can be stacked above each other in a similar fashion and the height of the stand can be constructed in accordance with the spatial requirements for the counter on which the stand rests.

It should be understood that while the base is a flat base it could be provided on a rotatable platform so that the stand is rotatable for ready access to each of the cells.

In the preferred construction the cells are transparent, however, for ease of understanding the present invention, the drawings have shown the cells as being opaque. Of course, transparent cells will better display the articles 30.

By having the cells oriented with their open face 28 inclined (FIG. 5), the articles 30 will drop into the lower corner of the cell as articles are pulled at random from each cell. Thus, the articles maintain an orderly appearance.

It should be understood that the use of the cube and the three-sided pyramid in the present structure make the most efficient use of the space provided above the pyramid. It is envisaged that other structures such as cylinders instead of cubes, may be employed for the cells. Also, it is envisaged that the converging sides 14 of the pyramid may not necessarily meet in an apex but the top of the pyramid may be cut off so long as the groups of cells adequately receive those converging sides such that some surface of each of the cells lie over the corresponding converging side of the base. It is believed that the three converging sides of the base are necessary to allow for the open faces of the cells to be inclined upwardly and outwardly of the stand.

Lastly, the display stand 10 preferably includes a decorative cap 35 (FIG. 3) which lies over the uppermost spacer 34.

What is claimed is:

1. A display stand for articles comprising:

a base having three converging sides defining a pyramid converging to a first apex;

a first group of three cells interconnected to provide respective inside surface portions that at least partially conform to the shape of said converging sides and are each adapted to lie over at least a portion of a corresponding one of said converging sides, each of said cells having an inclined opening for receiving one or more of the articles;

one or more additional cell groups constructed in the same manner as the first group of cells; and one or more spacers interspacing the first and additional groups; each of said spacers includes upper and lower opposing sets of three converging sides, the upper set of converging sides is received by the inside surface portions of the group of cells positioned above said each spacer and the lower set of converging sides has edges between adjacent converging sides resting upon surfaces of the cells of the group located below said each spacer.

2. The display stand of claim 1 wherein each group of three cells is interconnected to provide open spaces between adjacent surface portions of said cells, access to the open face of each cell is through a respective open space.

3. A display stand for elongate articles, comprising:

a base having three sloping sides defining a first pyramid and converging at a first apex; and a first group of three cubic cells interconnected to provide respective inside surfaces which conform to the shape of the sloping sides and which lie over a portion of a corresponding one of said sides and receive said pyramid, said cells each having one corner interconnected with a corresponding corner of the remaining two cells to provide a joint which is located immediately above said first apex, and each cell having an inclined open face for receiving one or more of said articles.

4. The display stand of claim 3 wherein the three cells are interconnected to provide open spaces between adjacent right-angled faces of said cubic cells, access to the open face of each cubic cell is through a respective open space.

5. The display stand of claim 4 wherein one face of each cubic cell faces outwardly of said stand in directions that are at right angles to each other.

6. The stand of claim 5 further including:

one or more additional groups of three cubic cells constructed in the same manner as said first group of cubic cells; and one or more cubic spacers interspacing the first and additional groups of cubic cells.

7. The stand of claim 6 wherein each of the cubic spacers is oriented with at least two of its opposing corners vertically aligned and defining a pyramid having an apex and an inverted pyramid having an inverted apex, said apex extending into the group of cubic cells stacked above the cubic spacer and the inverted pyramid having its inverted apex extending into the joint of the group of cubic cells oriented below the cubic spacer.

8. The stand of claim 7 wherein the cubic cells of each group are equal in size.

9. The stand of claim 7 wherein the cubic cells of each of the groups and the cubic spacers are equal in size.

10. The stand of claim 6 wherein two edges of each sloping side of each of the said pyramids and inverted pyramids meet at an angle of 90°.

11. The stand of claim 6 wherein the depth of the cubic opening is at least one-half the length of the elongated article contained therein.

12. The stand of claim 6 wherein articles contained in the cubic cells are oriented at an upward angle of 45° from the horizontal and said cells are oriented to provide a diamond shape appearance at the open face such that a converging lower edge is provided and into which said articles relocate as articles are removed from said cell.

13. The stand of claim 6 wherein articles are oriented with their longitudinal axis extending into said cubic cells.

14. The stand of claim 13 wherein the depth of said cubic cells permits articles to extend out of the cubic cells into the respective ones of the open spaces.

15. The stand of claim 6 wherein each of said joints are vertically aligned.

16. The stand of claim 6 wherein the cubic cells are transparent.

17. The stand of claim 16 wherein the cubic spacers are transparent.

* * * * *